US006238306B1

(12) United States Patent
Kakiuchi

(10) Patent No.: US 6,238,306 B1
(45) Date of Patent: May 29, 2001

(54) WOUND GOLF BALL AND MAKING METHOD

(75) Inventor: Shinichi Kakiuchi, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 09/262,868

(22) Filed: Mar. 5, 1999

(30) Foreign Application Priority Data

Mar. 5, 1998 (JP) ..... 10-071310

(51) Int. Cl.[7] ..... A63B 31/06
(52) U.S. Cl. ..... 473/356
(58) Field of Search ..... 473/351, 354, 473/363, 364, 356

(56) References Cited

U.S. PATENT DOCUMENTS

| | | | | |
|---|---|---|---|---|
| 4,938,471 | * | 7/1990 | Nomura et al. | 473/351 |
| 5,628,699 | * | 5/1997 | Maruko et al. | 473/363 |
| 5,674,137 | * | 10/1997 | Maruko et al. | 473/354 |
| 5,704,853 | * | 1/1998 | Maruko et al. | 473/363 |
| 5,766,096 | * | 6/1998 | Maruko et al. | 473/365 |
| 5,846,142 | * | 12/1998 | Kakiuchi et al. | 473/354 |

FOREIGN PATENT DOCUMENTS

| | | |
|---|---|---|
| 55-47873 | 4/1980 | (JP) . |
| 57-115270 | 7/1982 | (JP) . |
| 61-112619 | 5/1986 | (JP) . |
| 61-112620 | 5/1986 | (JP) . |
| 63-109879 | 5/1988 | (JP) . |

* cited by examiner

*Primary Examiner*—Mark S. Graham
*Assistant Examiner*—Raeann Gorden
(74) *Attorney, Agent, or Firm*—Sughrue, Mion, Zinn, Macpeak & Seas, PLLC

(57) ABSTRACT

In a thread-wound golf ball comprising a wound core composed of a center and a thread rubber layer, and a cover enclosing the core, the cover is of a two layer structure of an inner layer and a softer outer layer. The cover inner layer is formed by compression molding and the cover outer layer is formed by injection molding. The cover has a thickness of 1.0–2.5 mm. The cover inner layer penetrates to the thread rubber layer to a depth of 1.0–3.0 mm. Wound golf balls having improved flight performance, ease of control and durability against repetitive shots can be consistently manufactured to such quality.

13 Claims, 1 Drawing Sheet

WOUND GOLF BALL AND MAKING METHOD

This invention relates to thread-wound golf ball and a method for preparing the same.

BACKGROUND OF THE INVENTION

In the prior art, thread-wound golf balls are prepared by forming a cover around a wound core by a compression molding technique. The compression molding technique uses a molding press having for example 40 to 60 cavities. Owing to variances of temperature and pressure at the molding press surface and variances of working precision of cavities, wound golf balls as finished by the compression molding technique have large variations of the outer diameter and roundness as compared with injection molded solid golf balls. As compared with the injection mold, the molding press used in the compression molding technique must be provided with a greater number of cavities and thus requires a greater investment, which becomes a bar against cost-effective manufacture.

For wound golf balls, the injection molding of the cover as in the case of solid golf balls is desired in order to improve the productivity and stabilize the quality of wound golf balls. Various attempts were made to this end.

(1) For example, JP-A 47873/1980 and JP-A 115270/1982 describe golf balls prepared by impregnating a wound core with a latex containing 30 to 60% by weight of ionomer resin solids for causing the latex solids to penetrate into the network structure of the thread rubber layer for thereby integrally joining the cover to the thread rubber layer.

(2) JP-A 112618/1986 discloses the preparation of a golf ball by wrapping a pair of half-caps preformed from thermoplastic film over a wound core, compression molding the caps to form a protective layer, and injection molding a cover over the protective layer. AS to the compression molding of thermoplastic film, it is described to heat at a temperature at least 10° C. higher than the softening point of the caps and lower than 105° C.and to clamp the mold under a force of 100 to 1,000 kg for ½ to 3 minutes, preferably within one minute.

(3) JP-A 112619/1986 discloses a method for preparing a golf ball involving the consecutive steps of wrapping a wound core with a resilient thermoplastic film, causing heat shrinkage of the film to form a protective layer of substantially uniform gage closely bonded to the wound core, and injecting molding a cover over the surface of the protective layer.

(4) JP-A 109879/1988 discloses a golf ball which is prepared by wrapping a wound core with a thermoplastic resin film of 50 to 300 $\mu$m thick showing an area shrinkage factor of less than 10% when heated at a temperature of 100 to 180° C., and injection molding the same material as the film as a cover stock to enclose the wound core with the cover stock. The film is fused by the thermal inertia of the cover stock to thereby integrate the film with the cover stock.

Of these attempts of injection molding the cover of wound golf balls, the method of impregnating the thread rubber layer with the ionomer latex and the method of wrapping the wound core with the thermoplastic film eliminate the possibility that the heat applied during injection molding can degrade the thread rubber or cause the thread rubber to be ruptured and exposed at the cover surface, but have the drawback that the durability comparable to compression molding is not achievable because it is difficult to infiltrate the cover material deeply into interstices of the thread rubber layer for enhancing the bond of the cover to the thread rubber layer.

The injection molding method (2) of JP-A 112618/1986 fails to cause the half-cap material to deeply penetrate the thread rubber layer because the temperature and time of compression molding of the half-caps onto the wound core is low and short, respectively. No firm bond is established between the cover and the wound core.

SUMMARY OF THE INVENTION

Therefore, an object of the present invention is to provide a wound golf ball of quality wherein the bond of the cover to the wound core is improved so that the ball is fully durable against repetitive shots. Another object of the present invention is to provide a highly productive method for preparing such wound golf balls to consistent quality.

The inventors have found that crucial points in improving the durability of wound golf balls against repetitive shots are to protect thread rubber from the heat applied during molding of the cover, and to fully infiltrate the cover material into interstices of the thread rubber layer to enhance the joint of the cover to the thread rubber layer. For improving the cut resistance against iron topping, it is necessary to make the cover harder.

In a first aspect, the present invention provides a thread-wound golf ball comprising a wound core composed of a center and a layer of thread rubber wound onto the center, and a cover enclosing the core. The cover has a two layer structure consisting essentially of an inner layer and an outer layer having a lower hardness than the cover inner layer. The cover inner layer is formed by compression molding, and the cover outer layer is formed by injection molding. The cover inner layer and the cover outer layer have a total thickness of 1.0 to 2.5 mm. The cover inner layer penetrates to the thread rubber layer to a depth of 1.0 to 3.0 mm from the surface of the thread rubber layer. In preferred embodiments, the thread rubber layer has a density of 0.65 to 0.9 g/cm$^3$; the cover inner layer has a thickness of 0.2 to 1.0 mm and a Shore D hardness of 50 to 66,and the cover outer layer has a thickness of 0.8 to 2.0 mm and a Shore D hardness of 40 to 60; the center is a solid center having a diameter of 30 to 36 mm or a liquid center having a diameter of 26 to 32 mm.

The choice of these parameters enables the cover inner layer to be formed by compression molding without the risk of degrading the thread rubber. This also permits the cover inner layer material to evenly and fully penetrate into interstices of the thread rubber layer so that the bond of the cover inner layer to the thread rubber layer is significantly improved, resulting in an outstanding improvement in durability against repetitive shots. Since the cover inner layer plays the role of protecting the thread rubber, the cover outer layer can be formed by an injection molding technique featuring greater molding efficiency and productivity than by compression molding. As a consequence, there are obtained wound golf balls of quality having improved cut resistance, flight performance and ease of control.

In a second aspect, the invention provides a method for preparing a thread-wound golf ball comprising a wound core composed of a center and a layer of thread rubber wound onto the center, and a cover enclosing the core and consisting essentially of an inner layer and an outer layer, the method comprising the steps of encasing the wound core in a pair of half-cups preformed from a cover inner layer material, placing the assembly in one cavity of a molding press, and effecting compression molding to form the cover inner layer around the wound core; and placing the wound core with the cover inner layer in a cavity of an injection mold, and injecting a cover outer layer material into the cavity to form the cover outer layer on the cover inner layer. Preferably, each of the cover inner layer material and the cover outer layer material is based on an ionomer resin, and the compression molding of the cover inner layer is effected at a temperature of 125 to 160° C. for 2 to 5 minutes.

According to the method of the invention, when the cover inner layer is molded over the wound core, a conventional molding press may be used without a need for precision adjustment. The wound core enclosed with the cover inner layer at this point has greater variations of diameter and roundness than injection molded solid golf balls. Since the cover inner layer protects the thread rubber from heat and pressure, the cover outer layer can be molded over the cover inner layer by a conventional injection molding technique. Then wound golf balls of consistent quality having a minimal variation of diameter and a high roundness can be effectively produced utilizing the existing molding equipment.

DETAILED DESCRIPTION OF THE INVENTION

Figure 1:
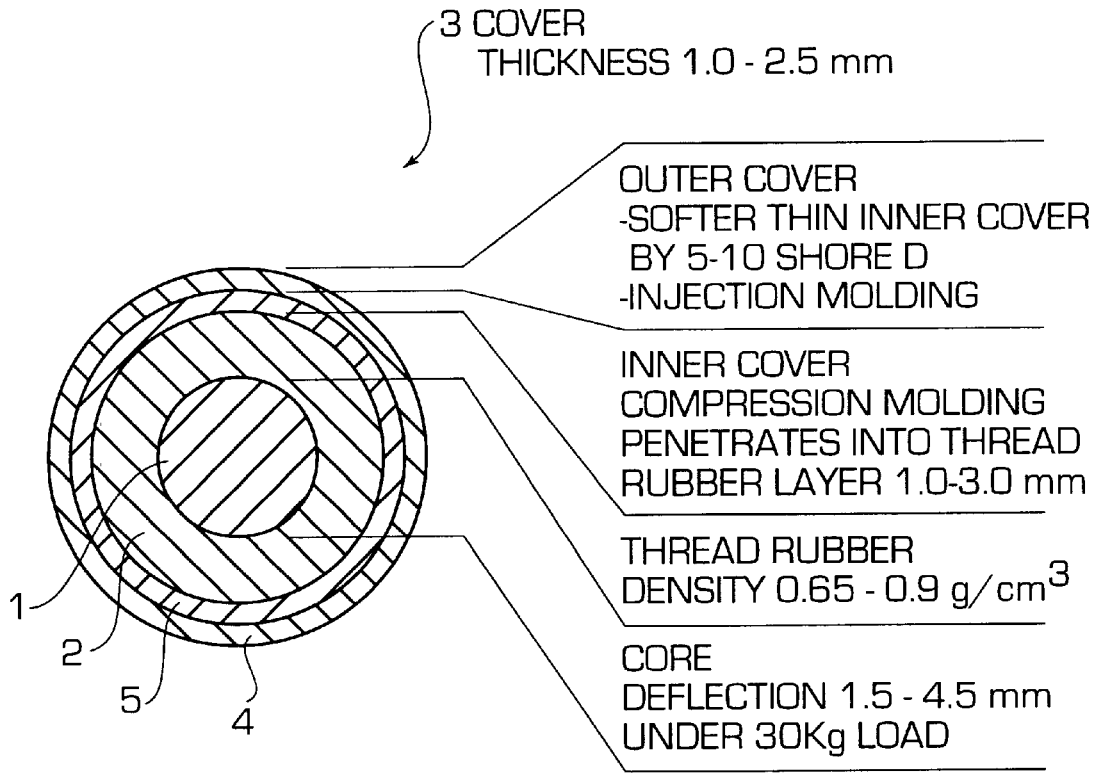
FIG. 1 is a schematic cross-section of the golf ball according to this invention.

The thread-wound golf ball of the invention has a wound core composed of a center and a layer of thread rubber wound onto the center. The wound core is enclosed in a cover. The cover is of a two layer structure consisting essentially of an inner layer and an outer layer. An intermediate layer is provided between the inner and outer layers if desired. The term "two layer structure" used herein does not exclude the provision of such an intermediate layer.

The center may be either a solid center or a liquid center. The solid center may be prepared by molding a well-known rubber composition in a mold under heat and pressure. Typically the composition is based on a rubber containing cis-1,4-polybutadiene as a main component, with which a peroxide, an inert filler, and additives are blended.

In one preferred embodiment, the solid center is formed from a composition comprising the following components.

| Components | Parts by weight |
|---|---|
| cis-1,4-polybutadiene | 100 |
| Zinc acrylate | 10–35 |
| Zinc oxide | 5–60 |
| Barium sulfate | 0–100 |
| Dicumyl peroxide | 0.5–2.0 |

Vulcanizing conditions include a temperature of 140 to 160° C. and a time of 10 to 20 minutes.

Preferably the solid center has a diameter of 30 to 36 mm, more preferably 30 to 34 mm and a hardness of 1.5 to 4.5 mm, more preferably 1.8 to 4 mm as expressed by a deflection under an applied load of 30 kg. The weight of the solid center is not critical although it is usually 15 to 30 grams, especially 17 to 28 grams. As to resilience, the solid center should preferably have a rebound of at least 95 cm, especially 97 to 110 cm when dropped under gravity from a height of 120 cm onto an iron disk having a diameter of at least 10 cm and a thickness of 10 cm.

On the other hand, the liquid center may also be prepared from well-known materials by well-known methods. Typically, the liquid center is prepared by filling a rubber made center bag with a filler liquid. Preferably the liquid center has a diameter of 26 to 32 mm, more preferably 29 to 31 mm and a weight of about 14 to 24 grams. The center bag usually has a gage of about 1.5 to 3 mm and a hardness of about 45 to 65 on JIS A hardness scale. The filler liquid may be any of well-known ones, for example, water, sodium sulfate solution, and pastes obtained by blending zinc white or barium sulfate in water.

Thread rubber is wound on the above-mentioned center to form a wound core. Well-known types of thread rubber may be used. In one preferred embodiment, the thread rubber is made of a composition comprising the following components.

| Components | Parts by weight |
|---|---|
| Polyisoprene rubber | 70–90 |
| Natural rubber | 10–30 |
| Zinc white | 1–10 |
| Stearic acid | 0–2 |
| Vulcanization accelerator | 1–3 |
| Sulfur | 0.5–2 |
| Specific gravity | 0.93–1.1, preferably 0.93–1.0 |

Parameters of thread rubber are not critical although it is preferred that the rubber thread used have a width of 1.4 to 2 mm, especially 1.5 to 1.7 mm, and a thickness of 0.3 to 0.7 mm, especially 0.4 to 0.6 mm. The ratio of thickness to width is preferably from 3/10 to 4/10. The thread rubber winding method is not critical. Any of random winding (also known as basket winding) and great circle winding methods may be used.

When thread rubber having a specific gravity of 0.93 to 1.0 is used, the thread rubber layer should preferably have a density of 0.65 to 0.9 g/cm$^3$, more preferably 0.7 to 0.85 g/cm$^3$, the density being defined as the overall weight of thread rubber divided by the volume of the thread rubber layer. If the density of the thread rubber layer is less than 0.65 g/cm$^3$, the degree of stretching of the thread rubber would be too low to insure resilience. If the density of the thread rubber layer is more than 0.9 g/cm$^3$, fewer interstices would be left after winding of thread rubber so that the cover material can penetrate the thread rubber layer with difficulty.

The wound core thus formed should preferably have a diameter of 36.6 to 40.6 mm and a weight of about 30 to about 40 grams.

In the wound golf ball of the invention, the cover inner layer is formed around the wound core by compression molding, and the cover outer layer which is softer than the inner layer is formed thereon by injection molding.

The cover inner layer is formed by preforming a pair of hemispherical half-cups from a cover inner layer material and compression molding the half-cups to the wound core. Adjustment is made such that the cover inner layer penetrates to the thread rubber layer to a depth of 1.0 to 3.0 mm from the surface of the thread rubber layer. The depth of amalgamation or penetration of the cover inner layer into the thread rubber layer is preferably 1.0 to 2.5 mm. With a penetration depth of less than 1.0 mm, the bond between the cover and the thread rubber layer is insufficient to provide durability against repetitive shots. With a penetration depth of more than 3.0 mm, resilience becomes low owing to the excessive amalgamation of the thread rubber layer with the cover inner layer. More particularly, a pair of hemispherical half-cups having a gage of 0.3 to 1.5 mm are preformed from a cover inner layer material, the wound core is encased in the half-cups, the assembly is placed in one cavity of a molding press typically having 40 to 60 cavities, and compression molding is effected under a pressure of 100 to 200 kg per cavity, at a temperature of 125 to 160° C., preferably 140 to 155° C. for about 2 to 5 minutes, preferably about 2 to 4 minutes. These preferred conditions are selected especially when an ionomer resin is used as the main component of the cover inner layer material. A compression molding temperature of lower than 125° C. is insufficient to secure a penetration depth of the ionomer-based cover material even when the molding time is prolonged. Above 160° C., the thread rubber can be thermally degraded during compression molding, resulting in a decline of resilience.

The cover inner layer as compression molded (that is, the actual cover inner layer) preferably has a thickness of 0.2 to 1.0 mm, more preferably 0.5 to 0.8 mm, and a Shore D hardness of 50 to 66, more preferably 55 to 66.

As described above, the cover inner layer material is generally based on well-known ionomer resins though the material is not limited thereto. Suitable ionomer resins as used herein include Himilan 1706, 1707, 1557, and 1555 from Mitsui-duPont Polychemical K.K. Ionomer resins may be used alone or in admixture of two or more. Preferably, the cover inner layer material has a melt flow rate (MFR) of 1.5 to 10.0 g/min., more preferably 1.5 to 7.0 g/min.

Next, the cover outer layer is formed around the sphere (wound core enclosed with cover inner layer) by injection molding. Conventional injection molding techniques may be employed. A molding temperature of 120 to 200° C. and a molding pressure of 900 to 1,800 kg/cm$^2$ are appropriate.

The cover outer layer preferably has a thickness of 0.8 to 2.0 mm, more preferably 1.0 to 1.6 mm. The cover inner layer and the cover outer layer have a total thickness of 1.0 to 2.5 mm, preferably 1.2 to 2.5 mm. If the overall cover thickness is less than 1.0 mm, the cover can be cut when topped with an iron club. With an overall cover thickness of more than 2.5 mm, the ball would become less resilient and travel a shorter distance.

Preferably, the cover outer layer has a Shore D hardness of 40 to 60, more preferably 45 to 55, which should be lower than that of the cover inner layer. The difference in hardness between the inner layer and the outer layer is preferably 5 to 10 Shore D units. If the cover inner layer is softer than the cover outer layer, the ball would be given a lower spin rate upon iron shots.

The cover outer layer may be made of well-known materials, typically ionomer resins like the cover inner layer material, for example, Himilan 1557 and 1856 from Mitsui-duPont Polychemical K.K. and Surlyn 8120 from E. I. dupont. Ionomer resins may be used alone or in admixture of two or more.

If the wound golf ball is manufactured such that a color difference ΔE between the cover inner layer and the cover outer layer is at least 3 as expressed in Lab color space by a calorimeter. More specifically if the surface of the cover inner layer is colored so that the interface between the cover inner layer and the cover outer layer may be visually observed, then there is obtained the advantage that local thickness variations in the cover can be visually ascertained. The values of the Lab color space are measured in accordance with JIS Z-8701.

Next, the method of the invention is described in detail. The method starts with the wound core which is prepared -in a conventional manner. A pair of hemispherical half-cups are preformed from the cover inner layer material. The wound core is encased in a pair of half-cups. The assembly is placed in one cavity of a molding press whereupon compression molding is effected at 125 to 160° C. for 2 to 5 minutes to form the cover inner layer around the wound core. The compression molding of the cover inner layer onto the wound core under such conditions has the advantages that thermal degradation of the thread rubber is avoided, the cover material penetrate fully into interstices of the thread rubber layer over the entire area, and the cover inner layer is tightly bonded to the wound core. In addition, the cover inner layer plays the role of a protective layer when the cover outer layer is subsequently formed thereon.

Next, the cover outer layer is formed around the sphere (wound core enclosed with cover inner layer) by conventional injection molding. More particularly, the sphere is placed in a cavity of an injection mold in alignment therewith, and the cover outer layer material is injected into the gap between the sphere and the cavity wall.

According to the method of the invention, compression molding using a conventional molding press can be employed for the molding of the cover inner layer. At this point, the sphere (wound core enclosed with the cover inner layer) may have greater variations of diameter and roundness than injection molded solid golf balls. Subsequently, the cover outer layer can be molded over the cover inner layer by a conventional injection molding technique. Then wound golf balls of consistent quality having a minimal variation of diameter and a high roundness can be effectively produced.

Like conventional golf balls, the wound golf ball of the invention is formed with a multiplicity of dimples in the surface. The indexes and arrangement of dimples are optimized for the purpose of further increasing the inertia moment and improving the flight performance.

First, the golf ball of the invention is formed with dimples such that, provided that the golf ball is a sphere defining an imaginary spherical surface, the proportion of the surface area of the imaginary spherical surface delimited by the edge of respective dimples relative to the overall surface area of the imaginary spherical surface, that is, the percent coverage of the ball surface by dimples is at least 65%, preferably 70 to 80%. With a lower dimple coverage of less than 65%, the above-mentioned improved flight properties, especially increased carry would be lost.

Secondly, a percent dimple volume is calculated as (overall dimple volume)/(ball volume)×100%. The ball volume is the volume of a true spherical ball assuming that the golf ball has no dimples in its surface and the overall dimple volume is the sum of the volumes of respective dimples. The percent dimple volume is 0.76 to 1%, preferably 0.78 to 0.94%. A percent dimple volume of less than 0.76% would invite a trajectory that is too high resulting in a shorter carry whereas a percent dimple volume of more than 1% would invite a too low trajectory, also resulting in a shorter carry.

The number of dimples is 350 to 500, preferably 370 to 480, more preferably 390 to 450. When the number of dimples is less than 350, each dimple must have a larger diameter, adversely affecting the sphericity of the ball. When the number of dimples is more than 500, each dimple must have a smaller diameter, sometimes losing the dimple effect. No particular limit is imposed on the diameter, depth, and cross-sectional shape of dimples. Usually the dimples have a diameter of 1.4 to 2.2 mm and a depth of 0.15 to 0.25 mm. There may be formed two or more types of dimples which are different in diameter and/or depth. The arrangement of dimples is not critical. Any of conventional dimple arrangements such as regular octahedral, regular dodecahedral, and regular icosahedral arrangements may be employed. Furthermore, the pattern formed on the ball surface by the dimple arrangement may be any desired one such as square, hexagon, pentagon, and triangle patterns.

While the golf ball of the invention has the above-mentioned construction, the ball hardness is preferably 2.4 to 3.8 mm, especially 2.6 to 3.4 mm as expressed by a deflection under a load of 100 kg.

It is understood that golf games are played under the common Rules of Golf over the world. It is, of course, prerequisite that with respect to weight, diameter, symmetry, and initial velocity, the golf ball of the invention should have, according to the Rules of Golf, a weight of not greater than 45.93 grams, a diameter of not less than 42.67 mm, and an initial velocity properly tailored to be not greater than 76.2 m/sec. when measured on apparatus approved by the R & A (a maximum tolerance of 2% (77.7 m/sec.) will be allowed and the temperature of the ball when tested shall be 23±1° C.).

There have been described wound golf balls having improved flight performance, ease of control and durability against repetitive shots, which can be consistently manufactured to such quality.

EXAMPLE

Examples of the invention are given below by way of illustration and not by way of limitation.

Examples 1–6 & Comparative Examples 1–3

Solid centers were formed by kneading solid center compositions of the following formulation in a kneader and vulcanizing them in a mold at 155° C. for 15 minutes.

| Solid center | |
|---|---|
| | Parts by weight |
| Composition | |
| Polybutadiene rubber | 100 |
| Zinc acrylate | 21 |
| Zinc oxide | 20 |
| Barium sulfate | 44 |
| Dicumyl peroxide | 1.2 |
| Parameters | |
| Diameter | 32.0 mm |
| Weight | 23.7 g |
| Specific gravity | 1.38 |
| Hardness | 1.80 mm |
| Rebound | 98.5 cm |

Note that the hardness is a deflection of the center under an applied load of 30 kg, and the rebound is a rebound height when dropped from a height of 120 cm.

Thread rubber of the following composition was wound around each of the solid centers, obtaining wound cores.

| Thread rubber | |
|---|---|
| Composition | Parts by weight |
| Polyisoprene rubber | 70 |
| Natural rubber | 30 |
| Zinc white | 1.5 |

-continued

| Thread rubber | |
|---|---|
| Composition | Parts by weight |
| Stearic acid | 1 |
| Vulcanization accelerator | 1.5 |
| Sulfur | 1 |
| Specific gravity | 0.93 |
| Dimensions, width | 1.55 mm |
| thickness | 0.55 mm |

A pair of hemispherical half-cups were formed from each of the cover inner layer materials shown in Table 1. The wound core was encased in a pair of half-cups in accordance with the combination shown in Table 2. The assemblies were placed in cavities of a molding press whereupon compression molding was effected. The molding temperature and time are shown in Table 2.

Thereafter, the cover outer layer materials shown in Table 1 were injected around the cover inner layers in accordance with the combination shown in Table 2, obtaining wound golf balls of Examples 1–6 and Comparative Examples 1–3.

The thus obtained golf balls had dimples formed in their surface with a dimple number of 396, a percent dimple coverage of 75%, and a percent dimple volume of 0.88%.

The wound golf balls were evaluated for hardness, penetration depth, flight performance, spin rate, and durability by the following tests. The results are also shown in Table 2.

Ball Hardness

A deflection (mm) of a ball under a load of 100 kg was measured.

Penetration Depth

The ball was disassembled. Rubber pieces were separated from the thread rubber layer until the binding with the cover inner layer material disappeared. The diameter of the unbound thread rubber layer was determined. The penetration depth is given by (D1–D2)/2 wherein D1 is the diameter of the wound core and D2 is the diameter of the unbound thread rubber layer.

Flight Test

Using a swing robot machine (Miyamae K.K.) and a driver (W#1, Pro 230 Titan, loft angle 10°, Bridgestone Sports Co., Ltd.), a ball was hit at a head speed of 45 m/sec. (HS45). Measured were a spin rate, initial velocity, elevation angle, carry and total distance.

Spin Rate

Using a swing robot machine (Miyamae K.K.) and a sand wedge (SW, Model 55-HM, loft angle 58°, Bridgestone Sports Co., Ltd.), a ball was hit at a head speed of 20 m/sec. (HS20). A spin rate was measured by means of a Science Eye (Bridgestone Sports Co., Ltd.).

Durability

Using a swing robot machine and a driver (Pro 230 Titan, loft angle 10°, Bridgestone Sports Co., Ltd.), a ball was hit 200 times at a head speed of 45 m/sec. (HS45) against an impact plate. The number of intact balls is expressed as an index based on 100 for the number of intact balls in Comparative Example 3.

TABLE 1

| | Cover stocks | | | |
|---|---|---|---|---|
| | A | B | C | D |
| Himilan 1706 | 50 | — | — | — |
| Himilan 1707 | 50 | — | — | — |
| Himilan 1557 | — | 100 | — | 25 |
| Himilan 1555 | — | — | 100 | — |
| Himilan 1856 | — | — | — | 25 |
| Surlyn 8120 | — | — | — | 50 |
| Barium sulfate | 1 | 1 | 1 | 1 |
| Titanium oxide | 2 | 2 | 2 | 2 |
| Dispersant/pigment | 1 | 1 | 1 | 1 |
| MFR, g/10 min. | 1.9 | 5.0 | 10.0 | 2.0 |
| Shore D hardness | 61 | 57 | 57 | 50 |

Note that Himilan is the trade name of ionomer resins by Mitsui-duPont Polychemical K.K., Surlyn is the trade name of ionomer resins by E. I. dupont, and MFR is a melt flow rate as measured at 190° C. in accordance with JIS K-6760.

TABLE 2

| | | E1 | E2 | E3 | E4 | E5 | E6 | CE1 | CE2 | CE3 |
|---|---|---|---|---|---|---|---|---|---|---|
| Wound core | Diameter (mm) | 39.1 | 38.8 | 38.8 | 39.3 | 38.8 | 39.1 | 38.8 | 36.7 | 38.8 |
| | Weight (g) | 34.4 | 33.9 | 33.9 | 33.0 | 33.9 | 34.4 | 33.9 | 30.2 | 32.3 |
| Thread rubber layer | Volume ($cm^3$) | 14.1 | 13.4 | 13.4 | 12.3 | 13.4 | 14.1 | 13.4 | 8.7 | 13.4 |
| | Density ($g/cm^3$) | 0.75 | 0.76 | 0.75 | 0.75 | 0.75 | 0.75 | 0.75 | 0.75 | 0.76 |
| Cover inner layer | Formulation | A | A | A | A | B | C | A | A | D |
| | Shore D hardness | 61 | 61 | 61 | 61 | 57 | 57 | 61 | 61 | 50 |
| | MFR (g/10 min.) | 1.9 | 1.9 | 1.9 | 1.9 | 5.0 | 10.0 | 1.9 | 1.9 | 2.0 |
| | Thickness (mm) | 0.3 | 0.5 | 0.5 | 0.7 | 0.5 | 0.3 | 0.5 | 1.0 | 0.5 |
| | Compression molding temperature (° C.) | 145 | 135 | 145 | 145 | 145 | 140 | 120 | 145 | 145 |
| | Compression molding time (min.) | 4.0 | 5.0 | 4.0 | 4.0 | 4.0 | 4.0 | 4.0 | 4.0 | 4.0 |
| | Penetration depth (mm) | 1.5 | 1.8 | 1.9 | 1.8 | 2.2 | 2.1 | 0.8 | 1.9 | 1.8 |
| Cover outer layer | Formulation | D | D | D | D | D | D | D | D | B |
| | Shore D hardness | 50 | 50 | 50 | 50 | 50 | 50 | 50 | 50 | 57 |
| | Thickness (mm) | 1.5 | 1.5 | 1.5 | 1.5 | 1.5 | 1.5 | 1.5 | 2.0 | 1.5 |
| Ball | Outer diameter (mm) | 42.68 | 42.69 | 42.68 | 42.69 | 42.69 | 42.68 | 42.68 | 42.70 | 42.69 |
| | Weight (g) | 45.3 | 45.3 | 45.3 | 45.4 | 45.4 | 45.1 | 45.1 | 45.4 | 45.3 |
| | Hardness (mm) | 2.95 | 2.90 | 2.95 | 2.90 | 2.98 | 2.95 | 3.00 | 2.95 | 2.93 |
| W#1/HS45 | Initial velocity (m/s) | 65.7 | 65.5 | 65.5 | 65.3 | 65.3 | 65.3 | 65.1 | 65.0 | 65.6 |
| | Spin (rpm) | 2750 | 2730 | 2750 | 2790 | 2710 | 2700 | 2660 | 2830 | 2550 |
| | Elevation angle (°) | 12.0 | 12.0 | 11.9 | 12.0 | 11.9 | 11.9 | 11.7 | 11.6 | 12.1 |
| | Carry (m) | 208.4 | 208.1 | 207.8 | 208.8 | 208.1 | 208.3 | 206.1 | 206.2 | 209.1 |
| | Total (m) | 222.4 | 222.0 | 221.8 | 221.5 | 222.1 | 221.7 | 219.7 | 218.5 | 222.3 |
| SW/HS20 | Spin (rpm) | 5300 | 5350 | 5330 | 5250 | 5400 | 5380 | 5190 | 5120 | 4540 |
| Durability index | | 90 | 100 | 100 | 120 | 120 | 120 | 50 | 120 | 100 |

The ball of Comparative Example 1 is less durable against repetitive shots because the compression molding temperature is so low as 120° C. that the penetration depth of the cover inner layer into the thread rubber layer is 0.8 mm and the bond of the wound core to the cover is weak. The ball of Comparative Example 2 is low in initial velocity and distance because the total thickness of the cover inner and outer layers is as large as 3.0 mm and the thickness of the thread rubber layer, that is, the proportion of the resilient section is accordingly reduced. The ball of Comparative Example 3 is low in spin rate and especially, less controllable upon sand wedge shots, because the cover inner layer is softer than the cover outer layer.

By contrast, the balls of Examples 1–6 are excellent in all of flight performance, spin rate and durability. More specifically, the ball of Example 1 has the same construction as the ball of Example 6 except for the cover inner layer. The ball of Example 1 is less durable than the ball of Example 6 as demonstrated by a durability index of 90 for Example 1 and 120 for Example 6. This is because the MFR of the cover inner layer is 1.9 g/min. in Example 1 and 10.0 g/min. in Example 6, indicating that using a cover inner layer material having a higher MFR is effective for durability improvement.

Although some preferred embodiments have been described, many modifications and variations may be made thereto in the light of the above teachings. It is therefore to be understood that within the scope of the appended claims, the invention may be practiced otherwise than as specifically described.

What is claimed is:

1. A thread-wound golf ball comprising; a wound core composed of a center and a layer of thread rubber wound onto the center, and a cover enclosing said core, said thread rubber layer has a density of 0.65 to 0.9 $g/cm^3$, said cover being a two layer structure consisting essentially of a cover inner layer and a cover outer layer, said cover outer layer having a lower hardness than said cover inner layer, said cover inner layer has been formed by compression molding and said cover outer layer has been formed by injection molding, said cover inner layer and said cover outer layer have a total thickness of 1.0 to 2.5 mm, and said cover inner layer penetrates to the thread rubber layer to a depth of 1.0 to 3.0 mm from the surface of the thread rubber layer.

2. The golf ball of claim 1 wherein said cover inner layer has a thickness of 0.2 to 1.0 mm and a Shore D hardness of 50 to 66, and said cover outer layer has a thickness of 0.8 to 2.0 mm and a Shore D hardness of 40 to 60.

3. The golf ball of claim 1 wherein said center is a solid center having a diameter of 30 to 36 mm.

4. The golf ball of claim 1 wherein said center is a liquid center having a diameter of 26 to 32 mm.

5. A method for preparing a thread-wound golf ball comprising the steps of; forming a wound core composed of a center and a layer of thread rubber having density of 0.65 to 0.9 $g/cm^3$ wound onto the center, encasing the wound core in a pair of half-cups performed from a cover inner layer material, and placing the assembly in one cavity of a molding press, followed by compression molding to form a cover inner layer around the wound core, and placing the wound core with the cover inner layer in a cavity of an injection mold, and injecting a cover outer layer material into the cavity to form a cover outer layer on the cover inner layer.

6. The method of claim 5 wherein each of the cover inner layer material and the cover outer layer material is based on an ionomer resin, and the compression molding of the cover inner layer is effected at a temperature of 125 to 160° C. for 2 to 5 minutes.

7. The golf ball of claim 1, wherein a difference in hardness between said cover inner and outer layers is in the range of 5 to 10 Shore D units.

8. The golf ball of claim 3, wherein said solid center has a deflection of 1.5 to 4.5 mm under an applied load of 30 kg.

9. The golf ball of claim 3, wherein said solid center has a weight in the range of 15 to 30 g.

10. The golf ball of claim 4, wherein said liquid center has a weight in the range of 14 to 24 g.

11. The golf ball of claim 4, wherein said liquid center comprises a center bag having gage in the range of 1.5 to 3 mm and filled with a liquid.

12. The golf ball of claim 1, wherein said thread rubber has a specific gravity of 0.93 to 1.0 and a density in the range of 0.65 to 0.9 g/cm$^3$.

13. The golf ball of claim 1, wherein said wound core has a diameter in the range of 36.6 to 40.6 mm and a weight in the range of 30 to 40 g.

* * * * *